US008277214B2

(12) United States Patent
Koljonen

(10) Patent No.: US 8,277,214 B2
(45) Date of Patent: Oct. 2, 2012

(54) DEVICE FOR INTENSIFYING A FLAME

(75) Inventor: Mika Koljonen, Lempaala (FI)

(73) Assignee: Burn Booster Oy, Lempaala (FI)

( * ) Notice: Subject to any disclaimer, the term of this patent is extended or adjusted under 35 U.S.C. 154(b) by 197 days.

(21) Appl. No.: 12/662,686

(22) Filed: Apr. 28, 2010

(65) Prior Publication Data

US 2010/0279236 A1 Nov. 4, 2010

(30) Foreign Application Priority Data

May 4, 2009 (FI) ..... 20095504

(51) Int. Cl.
*F23D 14/12* (2006.01)

(52) U.S. Cl. ..... 431/347; 431/100; 431/104; 431/110; 431/202; 431/252; 431/348; 431/353; 431/354; 431/355

(58) Field of Classification Search ..... 431/8, 100, 431/202, 252, 347, 348, 353, 354, 355, 104, 431/110

See application file for complete search history.

(56) References Cited

U.S. PATENT DOCUMENTS

| | | | | | |
|---|---|---|---|---|---|
| 609,034 | A | * | 8/1898 | Mahler | 431/329 |
| 1,062,640 | A | * | 5/1913 | Eimer | 239/432 |
| 1,231,019 | A | * | 6/1917 | Hauck | 431/217 |
| 1,398,676 | A | * | 11/1921 | Carleton | 431/252 |
| 1,405,100 | A | * | 1/1922 | Cornwell et al. | 239/427.3 |
| 1,702,162 | A | * | 2/1929 | Johnson | 431/238 |
| 1,991,418 | A | * | 2/1935 | Rowe et al. | 431/354 |
| 2,217,970 | A | * | 10/1940 | Shearman et al. | 431/363 |
| 2,384,510 | A | * | 9/1945 | Volkman | 126/116 R |
| 2,430,688 | A | * | 11/1947 | Schickler | 239/516 |
| 2,461,731 | A | * | 2/1949 | Guth | 239/413 |
| 2,869,629 | A | * | 1/1959 | Nerad | 431/115 |
| 3,150,708 | A | * | 9/1964 | Davis, Sr. et al. | 431/10 |
| 3,210,059 | A | * | 10/1965 | Nesbitt et al. | 432/222 |
| 3,223,141 | A | * | 12/1965 | Safford | 431/265 |
| 3,298,418 | A | * | 1/1967 | Briggs | 431/90 |
| 3,341,311 | A | * | 9/1967 | Pedersen | 44/361 |

(Continued)

FOREIGN PATENT DOCUMENTS

EP 0 209 703 A2 1/1987

(Continued)

OTHER PUBLICATIONS

Search Report issued in corresponding Finnish Patent Application No. 20095504, dated Feb. 15, 2010. (with English translation).

(Continued)

*Primary Examiner* — Kenneth Rinehart
*Assistant Examiner* — Jorge Pereiro
(74) *Attorney, Agent, or Firm* — Oliff & Berridge, PLC

(57) ABSTRACT

A device for intensifying a flame, comprising an object intended to be placed in front of the burner head, at a distance from said burner head, so that it is placed at least partly inside a flame extending from the burner head, and furthermore, said object being arranged to glow, heated by said flame. An apparatus for applying the device, for heating a liquid or air, comprising a burner and a combustion chamber, wherein the apparatus comprises an object in the combustion chamber. In the method, the device is installed in front of the burner head, or in an apparatus for heating a liquid or air, comprising an opening for the burner head, and a combustion chamber.

5 Claims, 2 Drawing Sheets

U.S. PATENT DOCUMENTS

| | | | | | |
|---|---|---|---|---|---|
| 3,453,084 | A | * | 7/1969 | Just et al. | 423/450 |
| 3,510,240 | A | * | 5/1970 | Rhinehart | 431/350 |
| 3,514,041 | A | * | 5/1970 | Van Rooyen | 239/427.3 |
| 3,693,887 | A | * | 9/1972 | Brodlin et al. | 239/500 |
| 3,737,281 | A | * | 6/1973 | Guth | 431/352 |
| 3,799,732 | A | * | 3/1974 | Brodlin | 431/347 |
| 3,816,061 | A | * | 6/1974 | Guth | 431/352 |
| 3,816,062 | A | * | 6/1974 | Bouvier | 431/355 |
| 4,373,901 | A | * | 2/1983 | Kaplan et al. | 431/186 |
| 4,488,869 | A | * | 12/1984 | Voorheis | 431/352 |
| 4,798,530 | A | * | 1/1989 | Sestrap | 431/354 |
| 2006/0088794 | A1 | * | 4/2006 | Purcell | 431/243 |
| 2009/0277337 | A1 | * | 11/2009 | Palmer et al. | 99/330 |

FOREIGN PATENT DOCUMENTS

| | | | | |
|---|---|---|---|---|
| FI | 34179 | A | | 2/1965 |
| FR | 2 505 983 | | | 11/1982 |
| FR | 2 582 781 | | | 12/1986 |
| JP | 04113111 | A | * | 4/1992 |
| WO | WO 2007/061055 | A2 | | 5/2007 |

OTHER PUBLICATIONS

Oct. 3, 2011 Office Action issued in Finnish Patent Application No. 20106289 (with English Translation).

* cited by examiner

DEVICE FOR INTENSIFYING A FLAME

The invention relates to a device for intensifying a flame. The invention relates to an apparatus for heating a liquid or air. The invention relates to a method for installation.

In solutions of prior art, the flame of a burner does not burn in an optimal way. For this reason, utilization of the prior art has not successfully lead to excellent efficiencies in exploiting the fuel burning process. In solutions of prior art, the operating efficiency of boiler plants, particularly boilers, for example in the burning of oil, has normally been about 85 to 90%, which means that about 10 to 15% of the energy of the available fuel remains unexploited. This leads to a situation, in which an excess of fuel must be used in solutions of prior art, to produce the heat output needed. With poor burning, the fuel costs also increase in the same proportion as the energy remains unexploited. Furthermore, with poorly burnt fuel, the quantity of emissions increases significantly higher than in a case of cleanly or almost cleanly burning process. In oil burning according to prior art, a considerable amount of emissions is released into the air, including, for example, carbon dioxide $CO_2$, sulphur dioxide $SO_2$, nitrogen oxides $NO_x$, as well as carbon monoxide CO.

It is an aim of the invention to eliminate said drawbacks and to present a solution, by means of which the flame of the burner can be made to burn with a hotter flame than in the solutions of prior art. Thus, the fuel applied burns in a more efficient and cleaner way. Thanks to the invention, the efficiency of the process is substantially improved, resulting in reduced fuel consumption and emission values. The solution according to the invention also keeps the burning environment (such as a boiler) substantially cleaner than in the solutions of prior art.

In this application, a boiler plant refers to an environment in which the flame of a burner burns in such a way that it heats a liquid, for example water, such as in a boiler, or air. The solution of the presented type is suitable for use both for intensifying the flames of burners used for heating various buildings and for various apparatuses used in industry and comprising the flame of a burner.

In addition to the quality of the fuel, other factors that affect the burning and its completeness as well as the formation of emissions include temperature, the mixing and the retention time in the combustion chamber. The flame intensifier presented as the solution increases the efficiency of the process to a substantial extent, usually by 3 to 10 percentage units, depending on the fuel used. Using the flame intensifier it is possible to achieve, for example in the burning of oil, an efficiency of 95 to 99%. Achieving such a good efficiency is based on the fact that the temperature of the flame of the burner rises to a significant extent. With the cleaner burning process achieved with the flame intensifier, a situation is achieved, in which it is possible to prolong the retention time in the combustion chamber. The possibility of prolonging the retention time is due to the fact that with the hotter flame, it is possible to provide such burning conditions that the flame remains sufficiently hot even in the case that the quantity of air supplied into the burner is reduced.

When the temperature of the flame of the burner rises, the water or air is warmed faster. For example, in a private house heated with oil, this will lead to a situation in which the operating time of the burner becomes shorter by about 5 to 10% than in the solutions of prior art. As a result, with the auxiliary device according to the invention, the oil consumption of private houses is reduced by about 5 to 10% per piece of real estate. The invention is suitable for use with not only oils (such as heavy oil and thin oil) but also a variety of other fuels. Examples to be mentioned include various gases (such as natural gas and liquid gas) and pellets.

The device according to the invention will be presented in claim 1. The apparatus according to the invention will be presented in claim 9. The method according to the invention will be presented in claim 13.

In the following, the invention will be described in more detail with reference to the appended drawings, in which.

Figure 1:
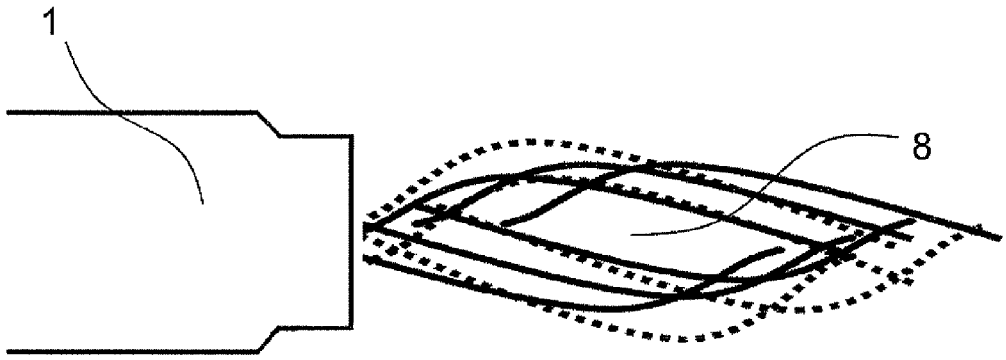
FIG. 1 shows a general view of the solution according to the prior art.

FIG. 1 shows a configuration for a burner of prior art, for example for a boiler of a private house. In this configuration, the flame burns freely in an air space. In the figure, the flame burns in an open space in front of the burner head 1. Said open space is normally a combustion chamber which is limited to the walls of the boiler which are heated by the flame. The heat is transferred by convection, typically to a liquid. The flame parts shown by dotted lines illustrate zones of incomplete combustion. When oil is used as the fuel and the air flow rate is kept constant at 433 l/min, the temperature of the flame is about 750 to 850° C. in an implementation of prior art. Thus, a burning efficiency of 85 to 90% is achieved.

Figure 2:
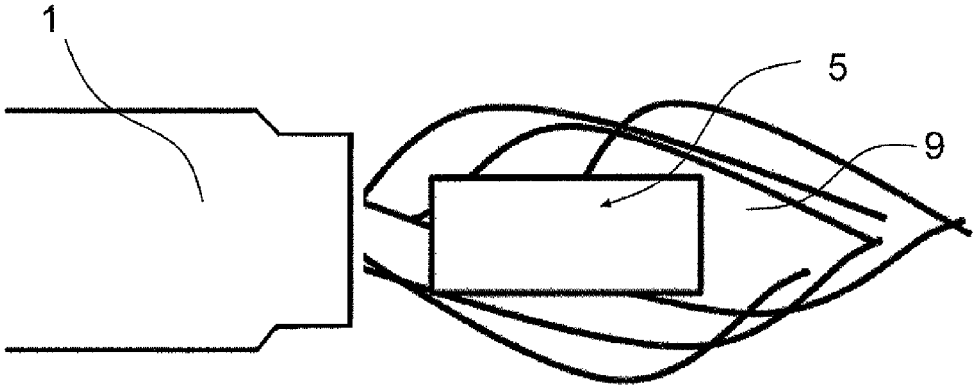
FIG. 2 shows a general view of the solution according to an example of the invention.

FIG. 2 shows a general view of the configuration according to the invention. Here, a separate object, namely a flame intensifier 5, has been installed in front of the burner head 1, to intensify the burning process. The flame intensifier 5 has been placed in front of the burner head 1 so that the flame intensifier is substantially in the centre of the flame, so that the flame intensifier is positioned substantially centrally with respect to the burner head 1 or its orientation. In the illustrated example, the central lines of the burner head 1 and of the circular flame intensifier 5 are substantially parallel and preferably also coincide with each other. Preferably, the flame intensifier 5 is almost of the size of the flame but such that the flame of the burner covers or encloses said object preferably entirely or almost entirely.

The burner head 1 constitutes a separate part to be fastened to the burner or an integral part of the burner. The burner head is typically fastened to a wall of the boiler plant or to a lid, through which the burner head extends into the combustion chamber. The burner is placed outside the combustion chamber.

In the solution according to the prior art, the size of the flame remains smaller (narrower) and, at the same time, the temperature of the flame 8 is also substantially lower than in the configuration according to the presented example. In the configuration according to the presented example, glowing of the flame intensifier 5 in the flame 9 contributes to the burning of the flame 9 so that the combustion is almost complete. The flame intensifier 5 does not change the length of the flame essentially, but its effect primarily manifests itself in heating of the flame as well as in an increase in the width of the flame.

The action of the flame intensifier 5 is based on the fact that enclosed by the flame 9 of the burner, the flame intensifier 5 absorbs thermal energy, and as a result, the material of the flame intensifier begins to glow, typically in red colour. The incandescent heat released by the flame intensifier 5 contributes to the burning process so that even such gases and microscopic drops of fuel are burnt that remain unburnt in configurations of prior art.

When oil is used as fuel in the configuration according to the presented example, the air flow rate can be reduced from the implementation of FIG. 1 to a value of, for example, 400 l/min so that the temperature of the flame rises further, in spite of the drop in the flow rate. In experiments, after the installation of the auxiliary device according to the flame intensifier 5, this rise in the temperature has been about 100° C. even after the above-mentioned drop in the flow rate, the temperature of the flame rising to temperatures of 850 to 950° C. The temperature rise caused by the auxiliary device improves the burning efficiency to a substantial extent. Furthermore, the reduction in the flow rate, which makes the increase in the temperature possible, has a positive effect on the efficiency of the burner. With the increase in the temperature and the drop in the flow rate, the efficiency of the burner according to the invention rises to a value of 95 to 99%.

Figure 3:
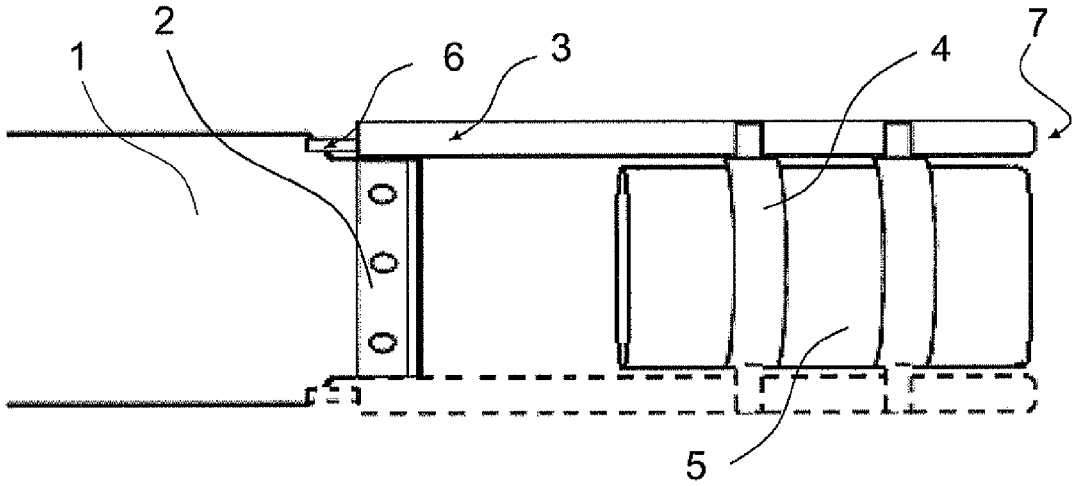
FIG. 3 shows a more detailed example of the solution according to the invention.

FIG. 3 shows a detailed example of a flame intensifier. The figure shows a flame intensifier 5 according to the invention added in front of the burner head 1, substantially centrally. The flame intensifier can be fastened in front of the burner by several different techniques, one example being shown in FIG. 3. The fastening shown in FIG. 3 comprises at least one supporting element, which in the example of the figure is a supporting pipe 3, as well as fastening means in the supporting pipe 3 which—in the example shown in the figure—are represented by supporting rings 4 keeping the flame intensifier 5 substantially in its position. The supporting element may be a bar as well. Preferably, the supporting element is a substantially straight supporting pipe 3, into which air can be introduced and through which air can be supplied to a desired point in the flame or the flame intensifier. The supporting element 3 comprises at least one air inlet 6 and at least one orifice 7 used as an air outlet in those cases, in which air is led through the supporting pipe. An outlet can also be used for introducing auxiliary air needed for burning.

In the presented example, several functions are combined in the supporting element: keeping the flame intensifier 5 in its position, introducing cooling air into the supporting element, and introducing auxiliary air into the flame, which gives significant advantages to the example in which these functions are separate. According to one embodiment, auxiliary air is introduced by means of a separate air pipe whose structure corresponds to the supporting element 3 but whose function is not to support the flame intensifier 5. The flame intensifier can also be connected to another location in the combustion chamber, in which case only said pipe is connected to the burner head 1, for example by means of a connecting ring 2.

The length of the flame intensifier 5 should be selected according to the environment in which it is used. The size of the flame intensifier 5 should be so large that the flame intensifier has a surface area sufficient to increase the temperature of the flame, but the size of the object 5 should still be so small that after the flame intensifier 5 there is still a sufficient air space for efficient burning of the flame of the burner. At least 50% or at least 60% of the surface area of the flame intensifier is placed inside the flame, and preferably the whole flame intensifier is placed inside the flame. When the flame intensifier 5 is used in burners of private houses, the length of the flame intensifier is preferably about 200 mm, a suitable range being from 100 mm to 250 mm. When the flame intensifier is used in larger boilers, other heating plants or industrial apparatuses, the size of the flame intensifier 5 should also increase in proportion with the size of the apparatus.

The diameter of the flame intensifier 5 should be selected according to the environment in which it is used. The flame intensifier 5, which is fastened in front of the burner head 1, should have an outer diameter which is sufficiently large, preferably approximately equal to the diameter of the fastening ring 2, to obtain a burning area that is sufficient to intensify the flame. However, at the same time, the outer diameter of the flame intensifier 5 should be so small that even with possible fasteners, the flame intensifier does not exceed the dimension of the outer diameter of the typically circular burner head 1 in those cases in which the installation space is limited in this way. In private houses, the outer diameter of the flame intensifier 5 is preferably about 75 mm, a suitable diameter being in the range from 65 mm to 85 mm.

In boilers of private houses, the material of the flame intensifier has a thickness of about 6 mm, the preferable thickness range being from 5 mm to 8 mm. The thickness of the material is of vital importance in view of the efficiency of the configuration according to the invention, because when heated, too thick a material will require an excessive proportion of the heating efficiency of the flame. This effect is particularly pronounced in cases in which the boiler, or the like, is heated intermittently so that the flame intensifier is cooled at least partly between heating cycles. A flame intensifier made of a sufficiently thin material is quickly heated to glow and is thereby ready for operation sooner. If the flame intensifier is placed in a continuously burning flame or, for example, in connection with industrial apparatuses, the thickness of the material may be even considerably greater, the thickness increasing in proportion with the size of the flame.

A free space must be left between the orifice of the burner head 1 and the flame intensifier 5, to provide auxiliary air needed in the burning process and entering inside the flame intensifier 5. If a sufficient air gap is not left between the flame intensifier 5 and the orifice of the burner head 1, the flame will tend to choke, in which case the burning process is no longer optimal. In an example, the flame intensifier 5 is placed at a distance of approximately its own outer diameter in front of the burner head 1, substantially in the centre of the flame.

The flame intensifier 5 is preferably made of a ceramic material, but other materials, such as, for example, fire-resistant special steel alloys, can also be used. In the use of other materials, a problem is their shorter service life when compared with the ceramic material. The ceramic material may be, for example, a cast or fire-resistant "brick pipe". In the present application, a brick pipe refers to a ceramic tubular object which may be, for example, a burnt pipe but also a cast unburnt ceramic pipe. It is essential for the selection of the material that the material to be selected has a high resistance to a thermal shock. As the size of the flame increases (for example in connection with industrial boilers), the material should be thicker than in connection with boilers intended for private houses.

When the flame intensifier 5 is fastened with a configuration similar to that shown in FIG. 3, the supporting pipe 3 is fixed to the burner head by means of fastening elements. These include preferably a fastening ring 2 that is placed around the burner head 1 and on whose outer surface the supporting pipe 3 or corresponding supporting element is fastened. The end of the burner head 1 is preferably provided with a necking or a collar in which the outer diameter is smaller than in the rest of the burner head and to which said fastening elements are connected.

If the space used has such limits, one should also make sure that the upper edge of the supporting pipe 3 does not protrude from the outer edge of the burner head 1. The fastening can be made, for example, by welding, with screws, or by another known fastening technique. There is at least one supporting pipe 3, but there may also be several of them. The supporting rings 4 fastened to the supporting pipe/pipes enclose the flame intensifier 5 of the burner and keep it substantially in position. There should be at least one supporting ring 4, preferably at least two of them.

When the flame intensifier 5 is installed in front of the orifice of the burner head 1 by means of the supporting pipe 3, air is preferably guided from the burner head 1 into the supporting pipe 3, for cooling the supporting pipe 3. In an embodiment, the supporting pipe 3 or an extension of it extends into the burner head 1 so that the inlet 6 is placed inside the burner head 1. The burner head is provided with an opening made for example by drilling, through which opening the supporting pipe 3 or its extension extends. The supporting pipe 3 is thus preferably an air pipe, in which air flows. The air flow is preferably taken from the burner head 1, so that the total amount of air introduced into the flame of the burner would be easier to control. Thus, there is no need for a separate air impeller or air supply for merely the supporting pipe or corresponding air pipe either, but it is possible to utilize the same air that is supplied to the burner head. By means of the cooling air, the service life of the supporting pipe 3 can be extended. If not cooled, the supporting pipe may easily yield (bend) under harsh process conditions, wherein the position of the flame intensifier 5 with respect to the flame will be changed, the swirls of the combustion air of the burner will be mixed, and the intensifier 5 will no longer function in an optimal way.

The introduction of air in the above-described way by means of the supporting pipe 3 will intensify the combustion in the rear part of the flame of the burner, at the rear end of the flame intensifier 5, which, for its part, will improve the intensity of the flame and the efficiency of the burning process. The purpose of the air is not only to cool the supporting pipe 3 but also to introduce auxiliary air to the outside of the flame intensifier 5 at the end that is farthest away from the burner head 1, and thereby to heat the flame further. The air can be led to the flame either directly from the end of the supporting pipe 3, or the supporting pipe 3 can be provided with separate auxiliary elements to guide the air flow. Furthermore, the supporting pipe 3 can be provided with separate orifices, from which the air can be introduced into the flame already slightly before the terminal end of the pipe 3, or into any desired point in the flame.

The supporting rings 4 and the supporting pipe 3 used for the fastening, or the materials for the corresponding supporting and fastening elements, preferably consist of fire-resistant steel, but also other suitable materials can be used. The supporting rings are preferably made of a relatively narrow metal. For example in boilers for private houses, a suitable material width is about 15 to 30 mm, measured from the broadest point.

The fastening elements, such as the supporting rings 4 and the supporting pipe 3, preferably comprise elements for adjusting the flame intensifier 5 in the longitudinal direction so that the flame intensifier 5 can be locked in position at a desired distance from the burner head 1. Such elements may comprise, for example, a sleeve which slides along the supporting pipe and to which the flame intensifier is attached. The flame intensifier can be locked in the desired position, for example, by means of screws.

The length of the supporting pipe is at least one that meets formula 1, preferably at least 10 mm longer than the result of formula 1:

$$p_{kp}=p_{lt}+p_{lt-pp}+p_k \quad (1)$$

in which $p_{kp}$ is the length of the supporting pipe, $p_{lt}$ is the length of the flame intensifier, $p_{lt-pp}$ is the distance between the flame intensifier and the burner head, $p_k$ is the length needed for making the connections.

According to an advantageous embodiment, the flame intensifier 5 of the burner is fastened in its position by fastening elements so that the flame intensifier 5 is allowed to "swing" back and forth, supported by the supporting rings 4, around an axis formed by the supporting pipe 3. Preferably, the movement of the flame intensifier 5 is limited substantially solely to this reciprocating movement around the axis formed by the supporting pipe 3. In this way, the flame intensifier 5 is movable by the effect of pressure caused by the burner so that the flame intensifier 5 can move to a position that is advantageous with respect to the flame, thereby intensifying the burning process further. Typically, the movement, by the effect of pressure, of the flame intensifier 5 around the axis formed by the supporting pipe 3 is only a few degrees. However, in test runs, this has been shown to be significant for the efficiency of the flame intensifier.

The fastening method is not limited to said fastenings, but the flame intensifier 5 of the burner can also be fastened in another suitable way. For example, the flame intensifier can be installed in the frame of the boiler, for example on a wall or a surface of its combustion chamber.

Figure 4:
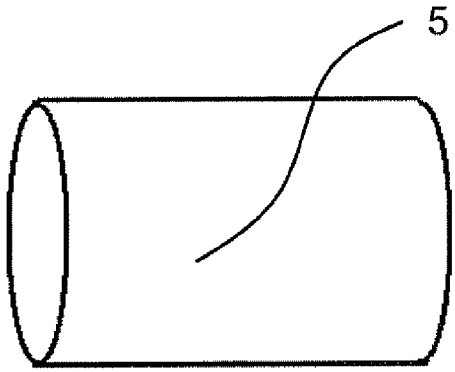
FIG. 4 shows a possible design for a flame intensifier.

FIG. 4 shows a particular embodiment of a flame intensifier 5 with a substantially circular tubular shape. Also other shapes can be used to intensify the burning process, as long as it is taken into account that the shape used does not mix the air swirls of the combustion air of the burner. To prevent mixing of the swirls of the combustion air, the shapes applied in the flame intensifier are preferably round or roundish also in the case that another shape is used than the tubular shape shown in FIG. 4. The flame intensifier may also consist of two or more parts whose cross-section constitutes a part of a substantially circular pipe. As a result of mixing of the air swirls of the combustion air, the efficiency of the flame intensifier 5 of the burner is reduced.

We shall now look at an example of a flame intensifier, in which a ceramic tubular object was installed in the centre of the flame of an oil burner, in front of the burner head. The circular tubular object (that is, the flame intensifier) had a length of about 200 mm and an outer diameter of about 75 mm. The thickness of the material used was about 6 mm. The distance between the object and the burner head was the same as the outer diameter of the ceramic object, that is, about 75 mm. The tubular object, the flame intensifier of the burner, was left fully within the burning flame. For the installation, an air-cooled supporting pipe and supporting rings formed of fire-resistant steel were used.

The temperature of the flame was measured both without and with the ceramic object (that is, the flame intensifier). Without the flame intensifier, the temperature of the flame was about 750° C. With the flame intensifier, the temperature of the flame rose by a total of 150 to 200° C., ending up in the range from 900 to 950° C. Except for the addition of the flame intensifier, the conditions were kept constant during the whole test. Among other things, the oil supply rate and the air flow were kept constant.

The flame intensifier is suitable for use in both permanent and temporary apparatuses used in connection with heating of buildings, as well as in various industrial apparatuses, in which the configuration comprises a flame of a burner. As the calculated efficiency (kWh) of the burner increases, the size of the flame intensifier and its distance from the burner head will also increase when the size of the burner head increases.

With the implementation according to the invention, the fuel consumption decreases and the emissions are reduced, because the efficiency of the burning process increases with the rising temperature of the flame. As the burning process becomes more efficient, this will decrease the quantity of emissions directly as well as indirectly by way of the lower fuel consumption.

The invention is not limited solely to the above-presented examples, but it can be applied within the scope of the appended claims.

The invention claimed is:

1. A device for intensifying a flame, the device comprising:

an object intended to be placed in front of a burner head, at a distance from the burner head, so that the object is placed at least partly inside a flame extending from the burner head, and the object is arranged to glow when heated by the flame; and fastening and supporting elements, by means of which the device is arranged to be fastened to the burner head, wherein the object is a circular pipe, and the fastening and supporting elements comprise supporting rings and a supporting pipe, and the device is movable around an axis formed by the supporting pipe, supported by the supporting rings.

2. The apparatus according to claim 1, the fastening and supporting elements further comprising an air pipe, through which air can be led from the burner head past the object to the flame.

3. The device according to claim 1, wherein the circular pipe has a length of 100 mm to 250 mm.

4. The device according to claim 1, wherein an average thickness of material of the circular pipe is 5 mm to 8 mm.

5. The device according to claim 1, wherein an outer diameter of the circular pipe is 65 mm to 85 mm.

* * * * *